US005769117A

United States Patent [19]

Wehber et al.

[11] Patent Number: 5,769,117

[45] Date of Patent: Jun. 23, 1998

[54] GUARD AND SEAT ASSEMBLY, AND A GUARD STRUCTURE THEREFOR

[75] Inventors: Wayne F. Wehber, Horseheads, N.Y.; Paul Wilkinson, Tulsa, Okla.

[73] Assignee: Dresser-Rand Company, Corning, N.Y.

[21] Appl. No.: 650,277

[22] Filed: May 20, 1996

[51] Int. Cl.[6] ..... F16K 15/00

[52] U.S. Cl. ..... 137/516.11

[58] Field of Search ..... 137/516.11, 516.13, 137/516.15, 516.17, 516.19, 516.21, 516.23; 417/525

[56] References Cited

U.S. PATENT DOCUMENTS

| | | | |
|---|---|---|---|
| 3,428,081 | 2/1969 | Kauffman et al. | 137/516.21 |
| 3,536,094 | 10/1970 | Manley | 137/516.11 |
| 4,130,131 | 12/1978 | Kucenty | 137/516.11 |
| 4,278,106 | 7/1981 | Cunningham | 137/516.13 |
| 4,632,145 | 12/1986 | Machu | 137/516.21 |
| 5,011,383 | 4/1991 | Bennitt | 137/516.15 |
| 5,015,158 | 5/1991 | Bennitt | 417/525 |

*Primary Examiner*—Marguerite McMahon
*Attorney, Agent, or Firm*—Bernard J. Murphy

[57] ABSTRACT

A fluid control valve has a valve guard and a valve seat, and the guard has a circular recess formed in a front surface thereof in which to nest the valve seat. In one embodiment, a pair of valve guards are integrally joined together by a plurality of webs which bridge therebetween via the rear surfaces of the guards.

6 Claims, 2 Drawing Sheets

GUARD AND SEAT ASSEMBLY, AND A GUARD STRUCTURE THEREFOR

This invention pertains to guard and seat assemblies, for fluid control valves, for use with reciprocable piston rods in straight cylinder gas compressors, and to guard structures therefor.

A U.S. Pat. No. 5,015,158, issued to Robert A. Bennitt, on 14 May, 1991, for a Gas Compressor, disclosed a gas compressor formed of a simple straight cylinder with end headers, and wholly confined valves. Replaceably fixed in the end headers are inlet, fluid control valves, and a reciprocating piston rod carries thereon, in spaced apart disposition, a pair of discharge, fluid control valves. The discharge valves have piston ring grooves formed in the peripheries thereof to receive sealing rings, whereby the discharge valves serve, also, as the gas compressing pistons.

The discharge valves, in the aforesaid patent, comprise a valve guard and a valve seat, the two being bolted together. In that the discharge valves experience most of the heat of compression, and further that they work the fluid in the intermediate portion of the cylinder, they are especially subject to thermal expansion and, as a consequence thereof, are susceptible to fretting where the guard-to-seat bolting is sited.

What has been needed is a guard and seat assembly, as well as a guard structure, for fluid control valves which are operative in elevated temperature environments, so designed as to obviate the aforesaid fretting.

It is an object of this invention, then, to set forth just such needed guard and seat assembly, and such a guard structure, for fluid control valves. Particularly, it is an object of this invention to disclose a guard and seat assembly, for a fluid control valve, comprising a guard, having front and rear surfaces; wherein said front surface has means for nesting a seat therewithin. Too, it is an object of this invention to set forth a guard structure, for guard and seat assemblies for fluid control valves, comprising a pair of guards; each of said guards having front and rear surfaces; said front surface of each of said guards has means for nesting a seat therewithin; and means integrally joining said rear surfaces together.

Further objects of this invention, as well as the novel features thereof, will be apparent from the following description taken in conjunction with the accompanying figures, in which.

Figure 1:
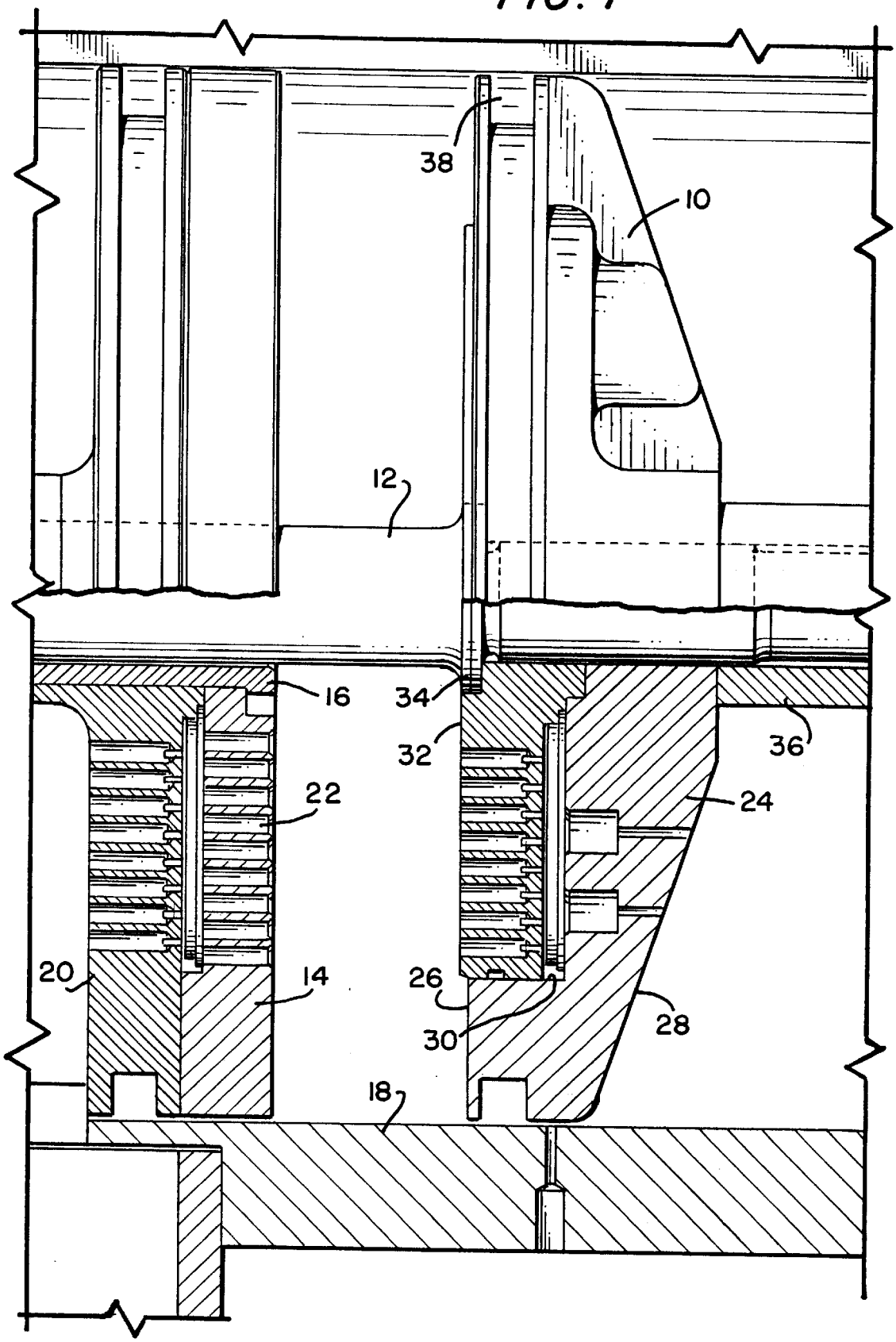
FIG. 1 is a side elevational view of a discharge, fluid control valve, half thereof being cross-sectioned, which incorporates an embodiment of the invention, i.e., the guard and seat assembly.

As shown in FIG. 1, a discharge, fluid control valve 10 is mounted onto a reciprocable piston rod 12, and confronting the valve 10 is an inlet, fluid control valve 14. Valve 14 is fixedly mounted on a hollow stub shaft 16, and the rod 12 penetrates the shaft 16 to accommodate reciprocation of the rod 12 with the discharge valve 10 thereon. The rod 12 and valves 10 and 14 are operative within a straight cylinder 18, and for a fuller understanding of the functioning of the valves 10 and 14 within the cylinder 18, reference is made to the aforementioned U.S. Pat. No. 5,015,158. Said patent is incorporated herein by the reference for a background disclosure of how the valves work the fluid, i.e., the gas.

Valve 14 has a valve guard 20 and a valve seat 22, and the two are configured for bolting together in the juxtapositioning as shown. Nor is this of any great disadvantage. Valve 14 works with the conduct of ingested gas, and as shown in the cited patent, is mounted by the stub shaft 16 in the relatively cooler end of the cylinder into an end header. However, valve 10 works with the through-conduct of compressed, heated gas, and is sited in the intermediate portion of the cylinder. Consequently, if it were to have its guard and seat bolted together, in juxtaposition, like valve 14, it would experience fretting where the bolting would be effected, as it operates in the elevated-temperature environment of the cylinder 18, with the hot gas.

The invention obviates the fretting problem by nesting the valve seat within the valve guard. Valve 10 has a valve guard 24 which has a front surface 26 and a rear surface 28. The front surface 16 has a circular recess 30 formed therein for nesting of the valve seat 32 therewithin. The rod 12 has a flange 34 formed thereon which engages the front of the seat 32, and a spacer 36 which is circumferentially engaged with the rod 12, engages the rear surface 28 of the guard. In this way, the valve 10 is secured onto the rod 12 for its reciprocation. With thermal expansion of the seat 32, the guard 24 absorbs the same and, as there is no bolting between the guard 24 and the seat 32, no fretting will occur. In order that the valve 10 will function, additionally, as a piston, for compressing gas within the cylinder 18, it can carry sealing rings thereabout. To this end, the valve guard 24 has an annular groove 38 formed therein about the periphery thereof, between the front and rear surfaces 26 and 28, respectively, for receiving such sealing rings. In the embodiment just described, the guard 24 is a separate component. The invention further teaches a novel guard structure usable in straight cylinder gas compressors, for the fluid control valves therein, such as the gas compressor described and illustrated in U.S. Pat. No. 5,015,158.

Figure 2:
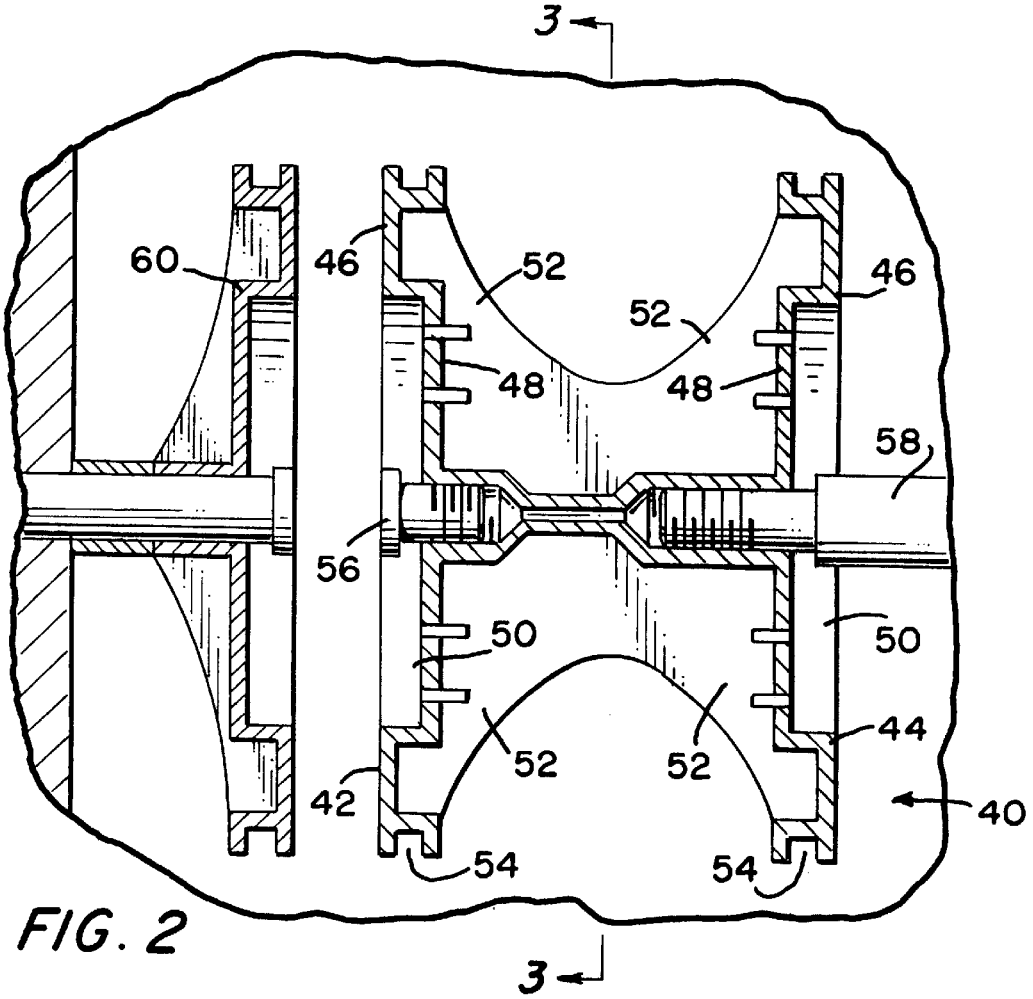
FIG. 2 is an axial cross-sectional view of the novel guard structure, also according to an embodiment thereof.
Figure 3:
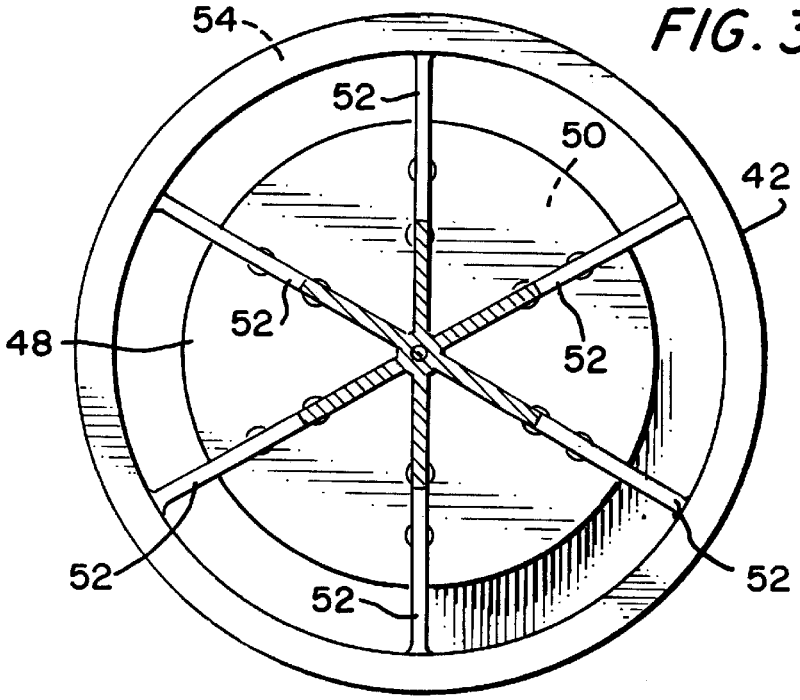
FIG. 3 is a cross-sectional view of the guard structure of FIG. 2 taken along section 3—3 of FIG. 2.

FIGS. 2 and 3 depict the inventive guard structure, according to an embodiment thereof. The novel guard structure 40 comprises a pair of guards 42 and 44, each thereof having front and rear surfaces 46 and 48, respectively. The front surfaces 46 of the guards 42 and 44 have circular recesses 50 formed therein, also for nesting therein a valve seat, similarly as explained in connection with valve 10 of FIG. 1. More, however, the guards 42 and 44 are integrally joined together by means of six webs 52 which extend from, and bridge between, the rear surfaces of the guards 42 and 44. Like guard 24 of FIG. 1, the guards 42 and 44 have annular grooves 54 formed in the peripheries thereof for receiving sealing rings. In this embodiment, the guard 42 is centrally bored and tapped to receive a threaded stub shaft 56, the same being provided to secure a nesting valve seat with the recess 50 of guard 42. Also, guard 44 is centrally bored and tapped to receive the threaded end of a piston rod 58. Guards 42 and 44 are represented as components for discharge valves. FIG. 2 shows an associated valve guard 60, configured quite like guard 44, which represents a component for an inlet valve as, clearly, the valve seat nesting, taught by our disclosure, can be employed in such inlet valves as well.

While we have described our invention in connection with specific embodiments thereof, it is to be clearly understood that this is done only by way of example, and not as a limitation to the scope of the invention as set forth in the objects thereof and in the appended claims.

We claim:

1. A guard structure, for guard and seat assemblies for fluid control valves, comprising:

a pair of valve guards;

each of said guards having front and rear surfaces; and means inseparably joining said rear surfaces together.

2. A guard structure, according to claim 1, wherein:

said front surface of each of said guards has means for nesting a valve seat therewithin.

3. A guard structure, according to claim 1, wherein:

said joining means comprises a plurality of webs bridging between said rear surfaces of said guards.

4. A guard structure, according to claim 2, wherein:

said nesting means comprises a circular recess formed in each of said front surfaces of said guards.

5. A guard structure, according to claim 1, wherein:

said guards are centrally bored.

6. A guard structure, according to claim 1, wherein:

said guards are centrally bored and tapped.

* * * * *